US007283941B2

(12) United States Patent
Horowitz et al.

(10) Patent No.: US 7,283,941 B2
(45) Date of Patent: Oct. 16, 2007

(54) COMPUTER SYSTEM AND METHOD FOR MODELING FLUID DEPLETION

(75) Inventors: Daniel H. Horowitz, Houston, TX (US); Gregory A. Stevens, Sugar Land, TX (US); Donald C. Swanson, Houston, TX (US); Jeffrey S. Swanson, Houston, TX (US)

(73) Assignee: Swanson Consulting Services, Inc., Houston, TX (US)

( * ) Notice: Subject to any disclaimer, the term of this patent is extended or adjusted under 35 U.S.C. 154(b) by 1283 days.

(21) Appl. No.: 10/013,743

(22) Filed: Nov. 13, 2001

(65) Prior Publication Data

US 2006/0142982 A1 Jun. 29, 2006

(51) Int. Cl.

| | |
|---|---|
| ***G06G 7/48*** | (2006.01) |
| ***G06G 7/50*** | (2006.01) |
| ***E21B 43/00*** | (2006.01) |
| ***E21B 47/00*** | (2006.01) |

(52) U.S. Cl. ..... 703/10; 703/9; 166/245; 166/252.2

(58) Field of Classification Search ..... 703/9, 703/10

See application file for complete search history.

(56) References Cited

U.S. PATENT DOCUMENTS

| | | | | | |
|---|---|---|---|---|---|
| 4,509,365 | A | | 4/1985 | Eineichner et al. | 73/151 |
| 4,710,876 | A | * | 12/1987 | Cline et al. | 345/423 |
| 4,821,164 | A | * | 4/1989 | Swanson | 703/10 |
| 4,969,130 | A | * | 11/1990 | Wason et al. | 367/73 |
| 4,991,095 | A | * | 2/1991 | Swanson | 702/16 |
| 5,001,677 | A | * | 3/1991 | Masters | 367/68 |
| 5,455,780 | A | * | 10/1995 | Nguyen et al. | 703/9 |
| 5,566,341 | A | | 10/1996 | Roberson et al. | 395/800 |
| 5,671,136 | A | * | 9/1997 | Willhoit, Jr. | 702/18 |
| 5,710,726 | A | * | 1/1998 | Rowney et al. | 703/10 |
| 5,729,451 | A | * | 3/1998 | Gibbs et al. | 703/2 |
| 5,757,663 | A | * | 5/1998 | Lo et al. | 702/12 |
| 5,835,882 | A | * | 11/1998 | Vienot et al. | 702/7 |
| 6,012,018 | A | * | 1/2000 | Hornbuckle | 702/16 |
| 6,023,656 | A | * | 2/2000 | Cacas et al. | 702/12 |

(Continued)

OTHER PUBLICATIONS

Introduction to Algorithms; Udi Manber; Addison Wesley Publishing Company; ISBN: 0-201-12037-2; pp. 190-197.*

(Continued)

*Primary Examiner*—Fred Ferris
*Assistant Examiner*—Akash Saxena
(74) *Attorney, Agent, or Firm*—Baker Botts L.L.P.

(57) ABSTRACT

A method for modeling fluid depletion in a reservoir is disclosed. A map is divided into cells. For each of the cells a value is stored that is based at least in part on a physical characteristic of the cell. At least one cell that contains a depletion location is identified along with a depletion amount corresponding to that location. An amount of walkers associated with the depletion location is determined. For each walker, a plurality of steps are calculated with each step to an adjacent cell. Each walker starts in the cell containing the depletion location associated with that walker. The visits of all the walkers are recorded by cell. The fluid depletion of each cell is then assessed based at least in part on the number of walker visits for each cell.

4 Claims, 11 Drawing Sheets

U.S. PATENT DOCUMENTS

| | | | | |
|---|---|---|---|---|
| 6,038,389 | A * | 3/2000 | Rahon et al. | 703/10 |
| 6,052,520 | A * | 4/2000 | Watts, III | 703/10 |
| 6,151,566 | A * | 11/2000 | Whiffen | 703/10 |
| 6,169,981 | B1 * | 1/2001 | Werbos | 706/23 |
| 6,230,101 | B1 * | 5/2001 | Wallis | 702/16 |
| 6,549,879 | B1 * | 4/2003 | Cullick et al. | 703/10 |
| 6,687,660 | B2 * | 2/2004 | Robinson et al. | 703/10 |
| 6,810,370 | B1 * | 10/2004 | Watts, III | 703/10 |
| 6,826,520 | B1 * | 11/2004 | Khan et al. | 703/10 |
| 6,842,725 | B1 * | 1/2005 | Sarda | 703/10 |
| 6,912,491 | B1 * | 6/2005 | Van Bemmel | 703/10 |
| 6,928,399 | B1 * | 8/2005 | Watts et al. | 703/9 |
| 2002/0016702 | A1 * | 2/2002 | Manceau et al. | 703/10 |

OTHER PUBLICATIONS

Stochastic Averaging and Estimate of Effective (upscaled) conductivity and transmitivity; IAMG99; Proc of 5th Annual Conf of Internanl. Asoc. for Mathematical Geology; D.M. Tartakovsky et al; 1999.*

Permiability Tensors for Sedimentary Structures; G.E. Pickup et al ; 1994; International Assoc. for Mathematical Geology vol. 26 No. 2 1994.*

Global Scale up of reservior model permiability with local grid refinement; D Li et al; Journal of Petroleum sciences and engineering (1995).*

Flow in Hetrogeneuos Porous Media; J.E. Warren et al.; Gulf research and Dev comapny; Sep. 1961.*

State of the Art Well Simulation; George B Holman; SPE 1982.*

Introduction to Algorithms; Udi Manber; Addison Wesley Publishing Company; ISBN: 0-201-12037-2; pp. 190-197—*—All previously cited and provided docs).*

Stochastic Averaging and Estimate of Effective (upscaled) conductivity and transmitivity; IAMG99; Proc of 5th Annual Conf of Internanl. Asoc. for Mathematical Geology; D.M. Tartakovsky et al; 1999.*

Permiability Tensors for Sedimentary Structures; G.E. Pickup et al ; 1994; International Assoc. for Mathematical Geology vol. 26 No. 2 1994.*

Global Scale up of reservior model permiability with local grid refinement; D Li et al; Journal of Petroleum sciences and engineering (1995).*

Flow in Hetrogeneuos Porous Media; J.E. Warren et al; Gulf research and Dev comapny; Sep. 1961.*

McCarthy, J. F., "Effective permeability of sandstone-shale reservoirs by a random walk method," *J. Phys. A: Math. Gen.* 23, L445-L451, 1990.

McCarthy, J. F., "Reservoir Characterization: Efficient Random-Walk Methods for Upscaling and Image Selection," SPE 25334 in *Proc. SPE Asia Pacific Oil and Gas Conf.*, Singapore, 159-171, 1993.

McCarthy, J. F., "Continuous-time random walks on random media," *J. Phys. A: Math. Gen.* 26, 2495-2503, 1993.

Yang, et al., "The Generation of Grid Block Permeabilities From Core Data," SPE 28753 in *Proc. SPE Asia Pacific Oil and Gas Conf.*, Melbourne, 127-134, 1994.

McCarthy, J. F., "Comparison of Fast Algorithms for Estimating Large-Scale Permeabilities of Heterogeneous Media," *Transport in Porous Media 19*, 123-137, 1995.

Tyler, K., "Paper IX Ranking of Production Performance from Detailed Geological Models," *Presented at the 4th European Conference on the Mathematics of Oil Recovery*, Roros, Jun. 7-10, 1994.

* cited by examiner

COMPUTER SYSTEM AND METHOD FOR MODELING FLUID DEPLETION

BACKGROUND

The invention relates to fluid reservoir analysis and more particularly to a computer system and method for modeling fluid depletion.

Underground reservoirs of petroleum fluids are depleted as the fluids are displaced toward production wells. Primary or secondary type recovery methods that are well-known to specialists can be used in order to better displace petroleum fluids towards production wells. In addition, new production wells can be drilled after initial depletion Adequate modeling of fluids that have been withdrawn from a reservoir and fluids that remain in the reservoir allows for both additional production wells and primary or secondary recovery methods to be more effectively employed to increase the recovery of petroleum fluids from a partially depleted field. The partially depleted field becomes more valuable as a result of the modeling that allows the subsequent use of the techniques under consideration.

Original analysis of the underground reservoir using coring, logging, seismic, or other techniques can produce information about the three dimensional extent of the reservoir and the amount of fluids therein. Obtaining sufficient data for an accurate description is expensive, and additional analysis for a partially depleted reservoir is generally not cost effective. If production has been monitored, the amount of petroleum fluids removed is a known quantity; however, it is generally difficult to determine the current state of fluids in a reservoir based only on the amount produced and the knowledge of the original state.

SUMMARY

In general, in one aspect, the invention features a method for modeling fluid depletion. A map is divided into cells. For each of the cells a value is stored that is based at least in part on a physical characteristic of the cell. A cell that contains a depletion location is identified along with a depletion amount corresponding to that location. An amount of walkers associated with the depletion location is determined. For each walker, a plurality of steps are calculated with each step to an adjacent cell. The first step for each walker is the cell containing the depletion location associated with that walker. The visits of all the walkers are recorded by cell. The fluid depletion of each cell is then assessed based at least in part on the number of walker visits for each cell.

In a more specific implementation of the disclosed method, the physical characteristic of the cell is a permeability of a fluid reservoir corresponding to the cell location in the map. In another more specific implementation of the disclosed method, the depletion amount is divided by the sum of walker visits recorded for the cells. Each cell is allocated a depletion volume based on the product of the depletion amount per visit and the number of visits recorded for that cell. If one or more cells is allocated more than a maximum depletion amount, the extra is allocated across the remaining cells in proportion to the number of visits recorded for those cells, with the redistribution proceeding until no cell is allocated more than a maximum depletion amount.

In general, in one aspect, the invention features a computer program with executable instructions that cause a computer to divide a map into cells. For each of the cells, the computer stores a value based at least in part on a physical characteristic of the cell. The computer identifies at least one cell that contains a depletion location along with a depletion amount corresponding to that location. The computer dispatches an amount of walkers from the depletion location. For each walker, a plurality of steps are calculated with each step to an adjacent cell. The first step for each walker is the cell containing the depletion location associated with that walker. The computer records the number of walker visits in each cell. The fluid depletion of each cell is then assessed based at least in part on the number of walker visits recorded for each cell.

One advantage of the claimed computer program and method is an assessment of fluid depletion by subportion of a map. Another advantage of the claimed computer program and method is modeling locations of preferred fluid flow. Another advantage of the claimed computer program is modeling depletion corresponding to a particular well.

Other and further features and advantages will be apparent from the following description of presently preferred embodiments of the invention, given for the purpose of disclosure and taken in conjunction with the accompanying drawings. Not all embodiments of the invention will include all the specified advantages. For example, one embodiment may only model depletion corresponding to a particular well, while another embodiment only models locations of preferred fluid flow.

DETAILED DESCRIPTION

Figure 1:
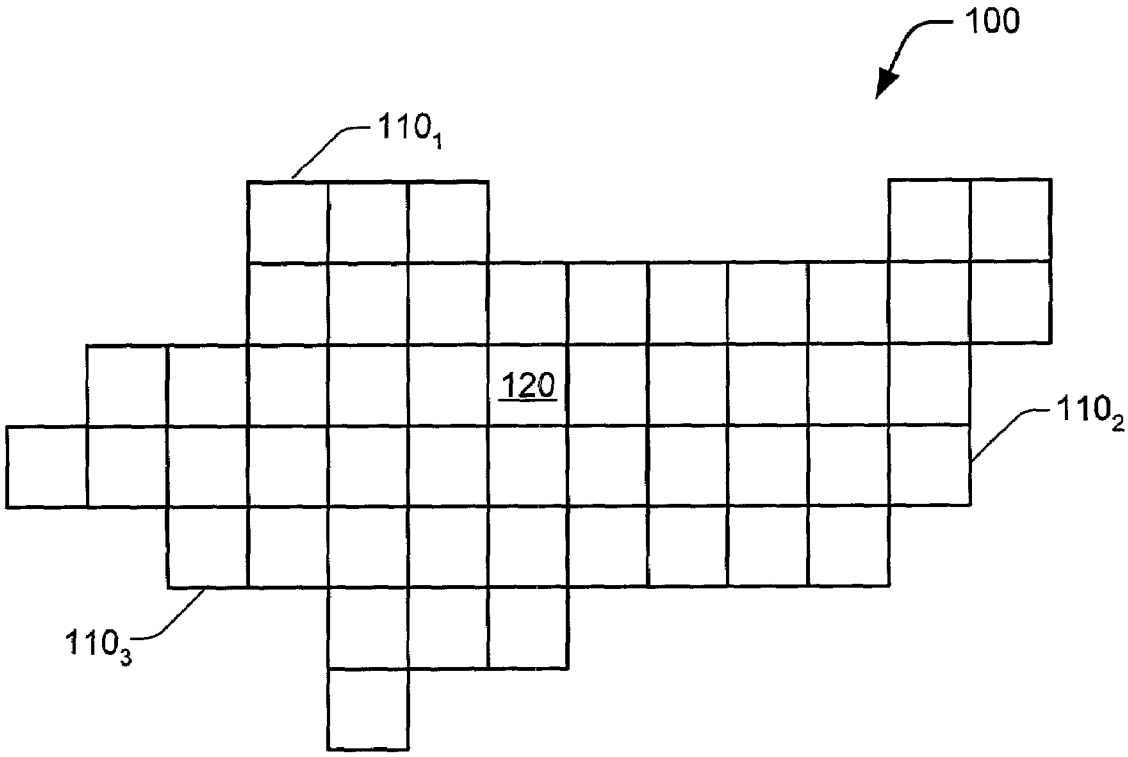
FIG. 1 is a fluid reservoir map divided into cells.

Referring now to the drawings, the details of preferred embodiments of the invention are schematically illustrated. Like elements in the drawings will be represented by like numbers, and similar elements will be represented by like numbers with a different lower case letter suffix.

Referring to FIG. 1, a map 100 of a fluid filled reservoir is shown. The map 100 depicts two dimensions, though three-dimensional and one-dimensional maps can be employed in other implementations of the present invention. The map 100 is divided into cells, for example $\mathbf{100}_{1\text{-}3}$, with each cell defined by its size and location. The cells shown are square. In another implementation, the cells can be arbitrarily shaped such that the map is divided into at least two portions. One of the cells 120 contains a depletion location. One example depletion location is a production well drawing fluid to the surface from an underground hydrocarbon reservoir. While cell 120 is depicted as located near the center of the fluid reservoir, cells containing depletion locations can be located anywhere in the reservoir. If a depletion location lies on the border between two cells, various compensations can be employed. For example, one cell can be treated as containing the depletion location or both cells can be treated as containing it.

Figure 2:
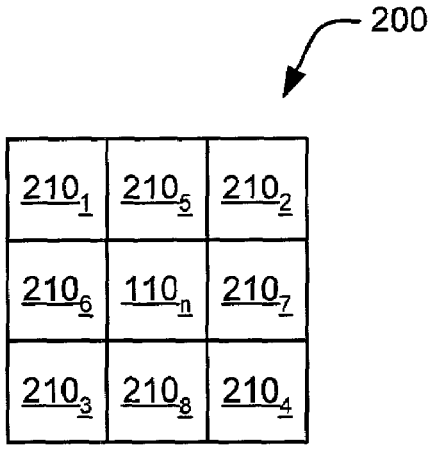
FIG. 2 is depicts a cell and its adjacent cells.

Once a map 100 has been divided into cells $\mathbf{100}_{1\text{-}3}$ and at least one cell 120 containing a depletion location has been identified, stochastic walkers are used to transform data regarding the physical characteristics of the cells and the depletion locations into data regarding per cell fluid depletion. FIG. 2 shows a group of cells including a current cell $\mathbf{100}_n$, four corner-adjacent cells $\mathbf{210}_{1\text{-}4}$, and four side-adjacent cells $\mathbf{210}_{5\text{-}8}$. A walker located in current cell $\mathbf{100}_n$, has eight possible adjacent cells into which it can step. In one implementation, the walker is only allowed to step into reservoir cells, so that if the walker is located in a cell on the margin or the outside edge of the reservoir, it will have fewer possible cells into which it can step. In one implementation, the walker is stopped once it reaches a margin or outside cell so that additional steps are only made when all adjacent cells are in the reservoir. In one implementation, a given walker that has already made steps does not consider any adjacent cell in which it has already been for determining its next step. In that situation a walker may reach a cell where all adjacent cells have been traversed, in which case it is retired. In another implementation, a walker only steps in side adjacent cells.

The walker chooses the cell for its next step using a stochastic process based on a value assigned to each adjacent cell and a random number. A transition probability for each neighbor cell is determined based on the relative values of those cells. In one implementation, the thickness of the net sand of the reservoir at the location defined by the map cell is used as the value for that cell. In that particular case, the transition probability is calculated based on the relative net sand thicknesses. Thus if cell $\mathbf{210}_1$ has twice the net sand thickness of cell $\mathbf{210}_2$, the walker is twice as likely to choose cell $\mathbf{210}_1$ (assuming that the walker is not barred from stepping into either cell because of a previous step). In another implementation, the permeability of the reservoir at the location defined by the cell, or another physical characteristic of that location, is used as the value and therefore part of the basis for calculating transition probabilities. In another implementation, a combination of physical characteristics is used. As another example, a transformed (e.g., logarithmic) measurement of a physical characteristic can be used.

In one implementation, the percentage chance that a walker will step into an eligible adjacent cell is equal to the physical characteristic value for that cell divided by the sum of values for all eligible adjacent cells. In another implementation, the physical characteristic values of the corner-adjacent cells $\mathbf{210}_{1\text{-}4}$ are modified. In one example, the percentage chance that a walker will step into an eligible corner-adjacent cell is equal to the physical characteristic value for that cell divided by the square root of 2 (the ratio of distance between the centers as compared to side adjacent cells). Thus, a side-adjacent cell having the same physical characteristic value as a corner-adjacent cell would have a better chance of becoming a step destination. Once the various percentage chances have been determined a random number is generated and compared to the various chances. For example, if only three adjacent cells are eligible and the first has twice the physical characteristic value as the other two, one implementation would generate a random number between 0 and 1. If the random number was less than 0.5, the first adjacent cell would be the step destination. If the random number was between 0.5 and 0.75, the second adjacent cell would be the step destination. If the random number was between 0.75 and 1, the third adjacent cell would be the step destination. In one implementation, the various probabilities are used to obtain a cumulative probability that is sampled stochastically to select a choice.

Figure 3A:
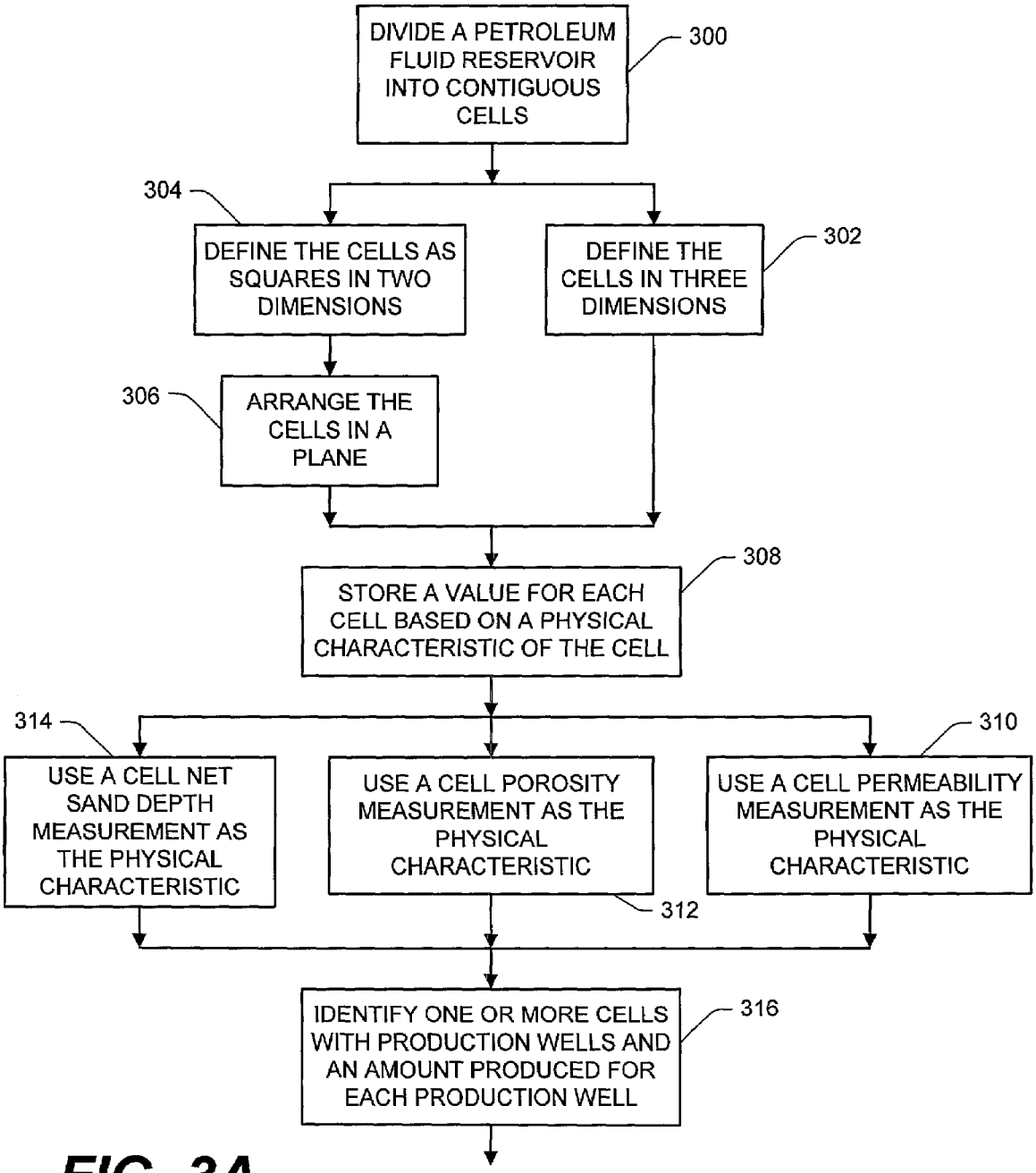
FIG. 3A is a first flowchart of a method in accordance with one implementation of the present invention.

FIG. 3A is a first flowchart of a method in accordance with one implementation of the present invention. A mapped petroleum-fluid reservoir is divided into contiguous cells 300. In another embodiment, see the example illustrated in FIGS. 5–9, the reservoirs are not contiguous. Two embodiments are depicted for defining the cells: in one the cells are defined in three dimensions 302, in the other the cells are defined in two dimensions as squares 304 and arranged in a plane 306. Once the cells are defined, a value is stored for each cell based on a physical characteristic of the reservoir portion represented by the cell 308. Example characteristics include net sand thickness 314, a measurement of permeability 310, a measurement of transmissivity or a characteristic that correlates with transmissivity 312. Production wells are identified and each is associated with at least one of the cells 316. An amount produced is also identified for each of the production wells for at least one time period 316. In a more complex implementation, amounts produced for multiple time periods for each of the production wells are identified.

Figure 3B:
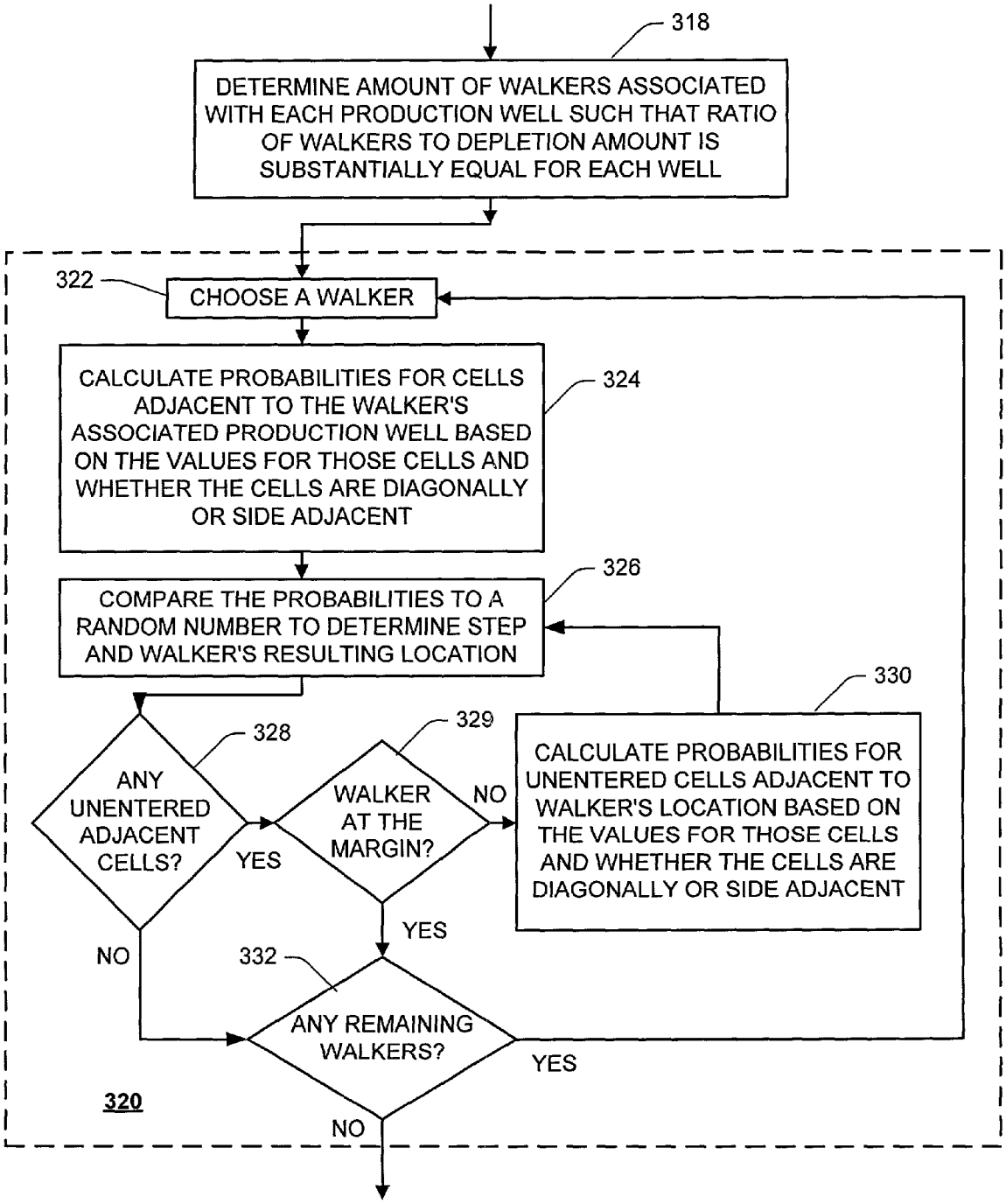
FIG. 3B is a second flowchart of a method in accordance with one implementation of the present invention.
Figure 3C:
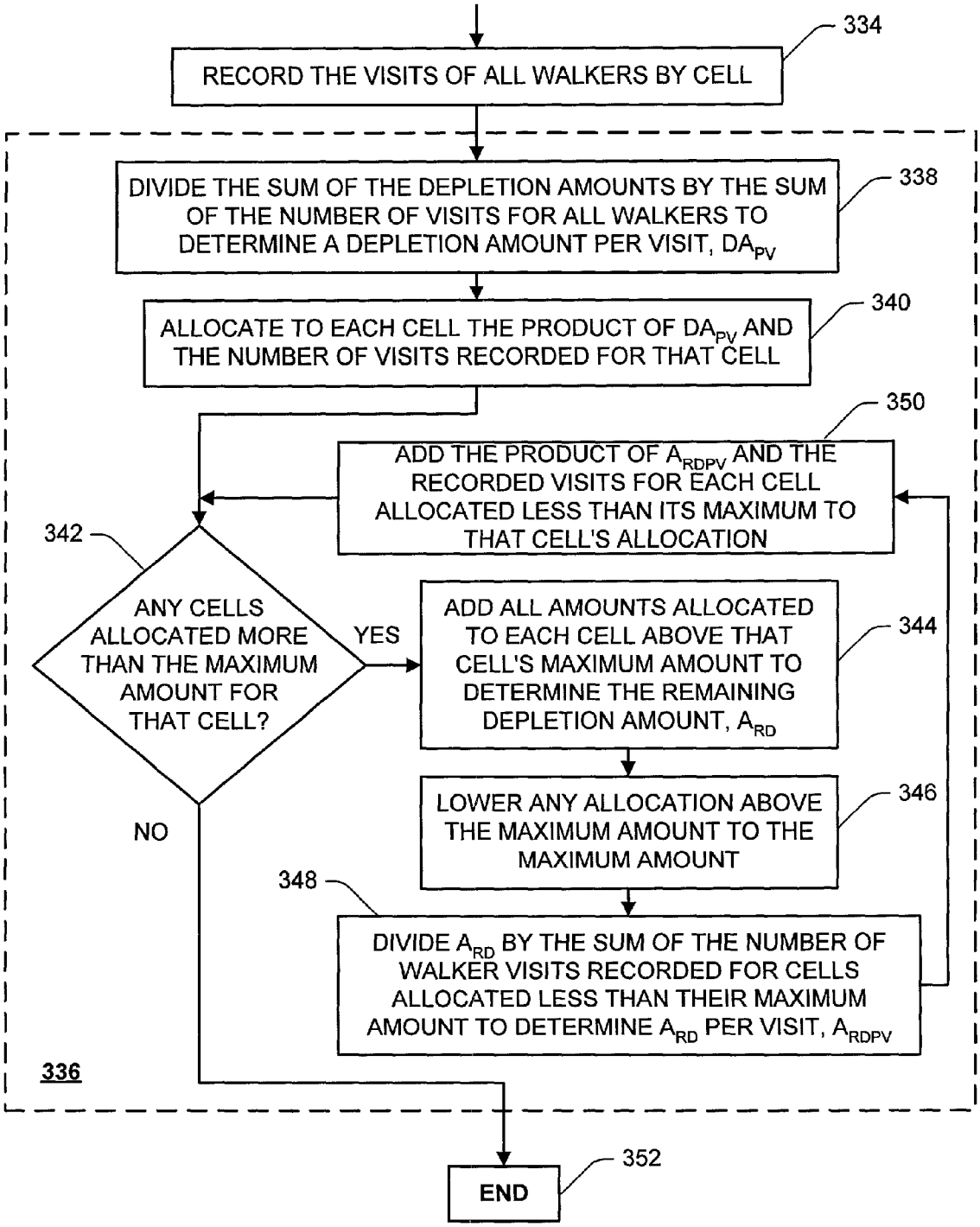
FIG. 3C is a third flowchart of a method in accordance with one implementation of the present invention.

FIG. 3B is a second flowchart of a method in accordance with one implementation of the present invention. A number of walkers to dispatch from each production well is determined such that the ratio of walkers associated with a well to the depletion amount for that well is substantially equal across all the wells 318. If only one production well is identified, there is only one ratio. In another embodiment, see for example FIGS. 4A–B, the walkers do not substantially correlate to depletion amount, e.g., they are a fixed number for each well. All walkers originate from cells with a production well. For a particular well, the walkers determine their steps 320. That process involves choosing a walker 322 that has not calculated its steps. The probabilities for stepping into cells adjacent to the production well associated with the walker are calculated based at least in part on the value for those cells and based at least in part on whether the cells are side-adjacent or corner-adjacent (also referred to a diagonally adjacent) 324. A random number is then compared to the probabilities to determine the step destination 326. If there are one or more cells adjacent to the destination that the walker has not visited 328 and the walker has not reached the margin 329, probabilities are calculated as discussed above for the adjacent cells 330 and another step is made 326. If there are no eligible, adjacent cells 328 or the edge of the reservoir has been reached 329, the walker is retired and, if there are more walkers to be dispatched 332, a new walker is chosen 322. If steps have been calculated for all the walkers 332, the process moves to FIG. 3C, a third flowchart of a method in accordance with one implementation of the present invention.

The number of times that any walker has visited a cell is recorded for each cell 334. In another embodiment the visits are recorded while they are determined 320. The fluid depletion of each cell is then assessed based at least in part on the number of walker visits recorded for that cell 336. The assessment includes dividing the sum of the depletion amount for the one or more wells identified by the number of walker visits recorded for all the cells 338. The number is the depletion amount per visit or $DA_{PV}$. In one embodiment, multiple wells exist in a reservoir, but the stochastic walkers are only used to model the depletion based on one of the wells. The product of $DA_{PV}$ and the number of visits recorded for each cell is allocated as depletion for that cell 340. If any cells are allocated more than a maximum amount for that cell 342, those over allocations are summed to determine the remaining depletion amount $A_{RD}$ 344. The allocation greater than the maximum are then lowered to the maximum 346. $A_{RD}$ per visit or $A_{RDPV}$ is calculated by dividing $A_{RD}$ by the number of visits recorded for cells allocated less than their maximum amount 348. The product of $A_{RDPV}$ and the number of visits recorded for each cell allocated less than its maximum amount is added to the allocation for that cell 350. If that addition results in over allocation 342, another redistribution occurs. Once no cell is allocated more than its maximum amount 342, the depletion has been assessed 336. The remaining fluid in a cell can be determined by the difference between the original fluid volume per cell and the allocated depletion.

Figure 4A:
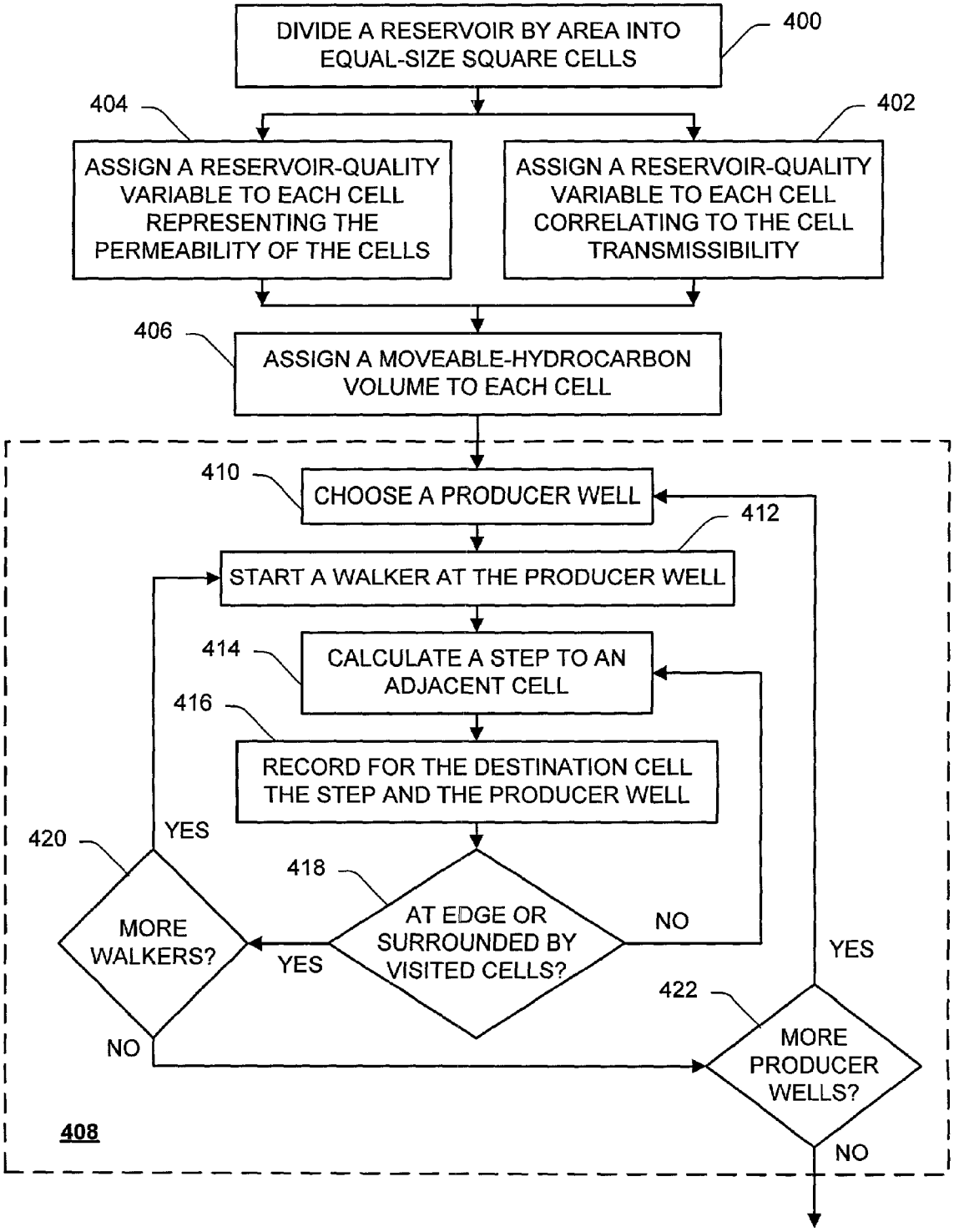
FIG. 4A is a first flowchart of a method in accordance with one implementation of the present invention.
Figure 4B:
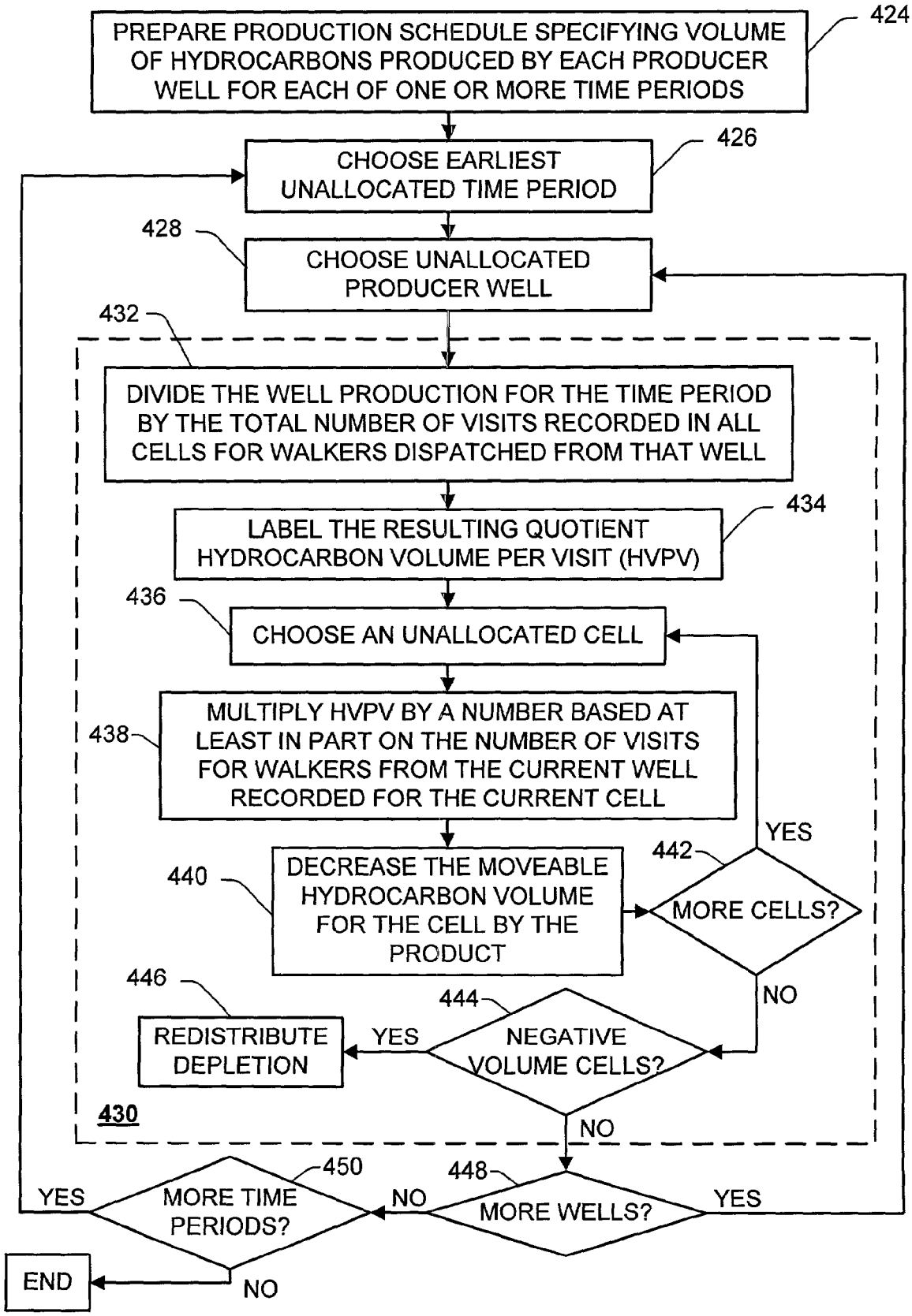
FIG. 4B is a second flowchart of a method in accordance with one implementation of the present invention.

FIGS. 4A–B are flowcharts of one method in accordance with one implementation of the present invention. A hydrocarbon fluid reservoir is divided by area into equal-size square cells 400. A reservoir-quality variable is assigned to each cell representing the permeability 404 or a variable correlating to the transmissivity of the cell 402. A moveable-hydrocarbon volume is also assigned to each cell 406. Walker steps are then calculated 408. First a producer well is chosen 410. A walker then originates at the producer well 412. A step to an adjacent cell is calculated 414. As discussed above, that calculation involves the reservoir-quality variables of adjacent cells and a random number. It can also involve the position of the cell relative to the current walker cell. Once the step direction is calculated, the destination cell records the visit as well as the producer well associated with the walker that made the step 416. Thus, in this embodiment, each cell is associated with a record of the number of visits by walkers originating from each producer well, not just the number of overall steps. If the walker is neither at the edge of the reservoir nor surrounded by unvisited cells 418, the walker takes another step 414. In one embodiment, the walker does take additional steps once it has reached a cell on the edge of the reservoir, if there are unvisited adjacent cells. A walker that is not taking any additional steps is retired. After each walker is retired, it is determined whether additional walkers should be dispatched from that producer well 420. If there are, a new walker is started. If there are not, another question is asked. If there are more producer wells to which the method is being applied 422, then another producer well is chosen 410. If all the producer wells being modeled have dispatched their walkers, then the steps depicted in FIG. 4B are implemented.

A production schedule is prepared that specifies the volume of hydrocarbons produced by each of the one or more producer wells being modeled (not necessarily all the actual producer wells) for each of one or more time periods 424. In another implementation, the fluid can be water or another fluid rather than hydrocarbons. The first unallocated time period is chosen 426. In another embodiment, a different time period is chosen first or a different order of time periods is used. An unselected producer well is chosen 428. The production for that well for that time period is then allocated 430. First, the well production for the time period is divided by the total number of visits recorded in all cells for walkers dispatched from that producer well 432. The result of that calculation is the hydrocarbon volume per visit (HVPV). An unallocated cell is chosen and HVPV is multiplied by the number of visits by walkers from the current producer well recorded for that cell 438 to determine the decrease in moveable hydrocarbon volume for that cell 440. If there are more cells 442, the process is repeated. The hydrocarbon volumes removed are checked to determine whether negative volumes remain 444. In the event of negative volumes, a redistribution can occur 446. The redistribution is similar to that described in FIG. 3C though on a per producer well basis rather than with all modeled producer wells at once. If no cell has a negative hydrocarbon volume, any remaining modeled producer wells are allocated 448. Once all the producer wells are allocated, additional time periods can be modeled 450. Once all the time periods (or all the time periods desired) are modeled, the remaining hydrocarbon volumes of the cells are assessed.

Figure 5:
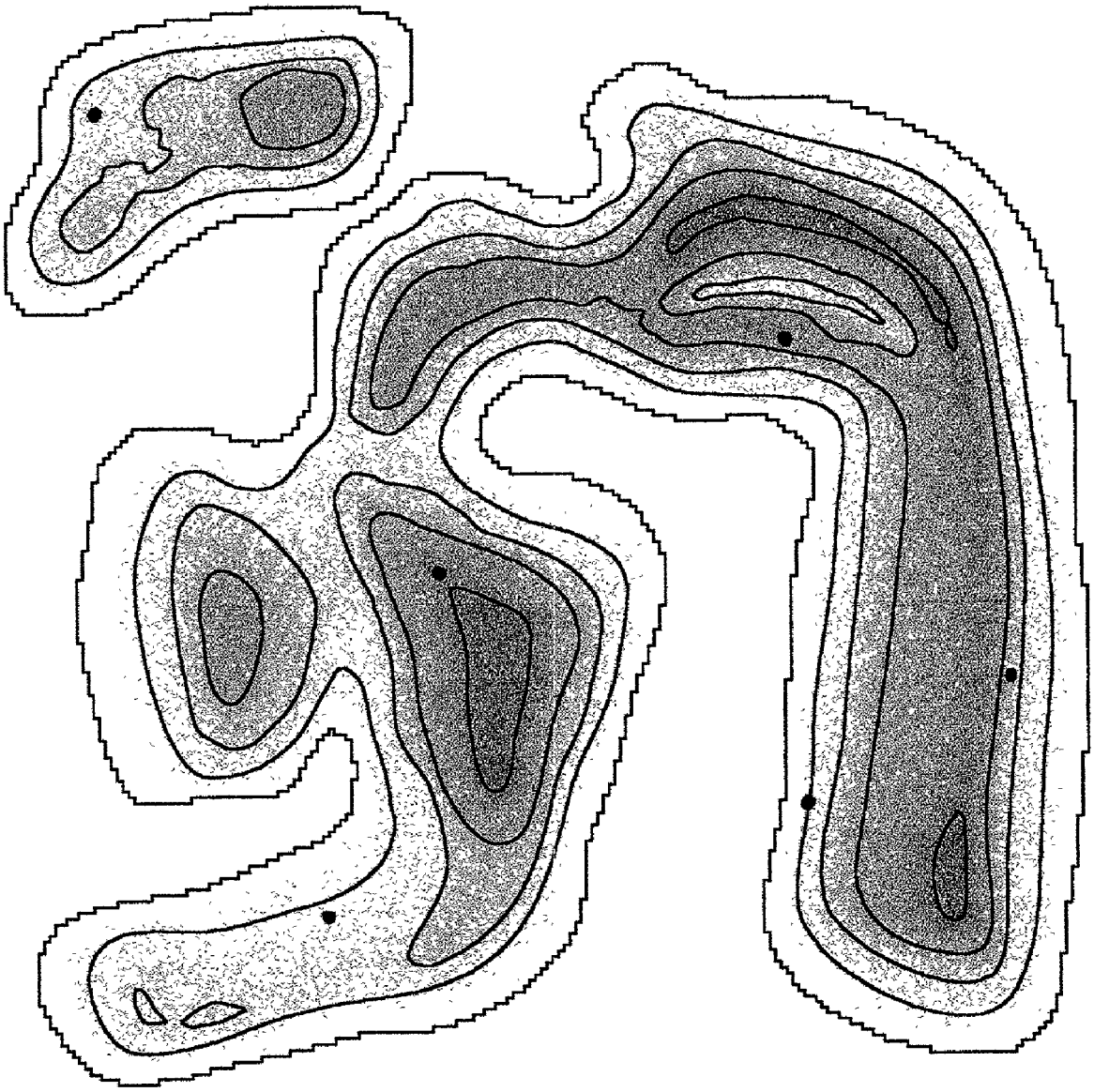
FIG. 5 is a fluid reservoir map indicating initial fluid levels and depletion locations.

FIGS. 5–9 correspond to results from an example use of the method. FIG. 5 is a fluid reservoir map indicating initial fluid volumes and depletion locations. The darkness of the coloration indicates the degree of initial fluid volume for a particular two-dimensional portion of the reservoir. As can be seen, the reservoir, and hence the cells into which it is divided, is not contiguous. One portion of the reservoir contains one producer well, while the other noncontiguous portion contains five producer wells. The two-dimension square cells into which the map is divided are very small relative to the map size in order to increase the granularity or resolution of depletion assessment. The contour lines correspond to measurements of reservoir characteristics in the third dimension.

Figure 6:
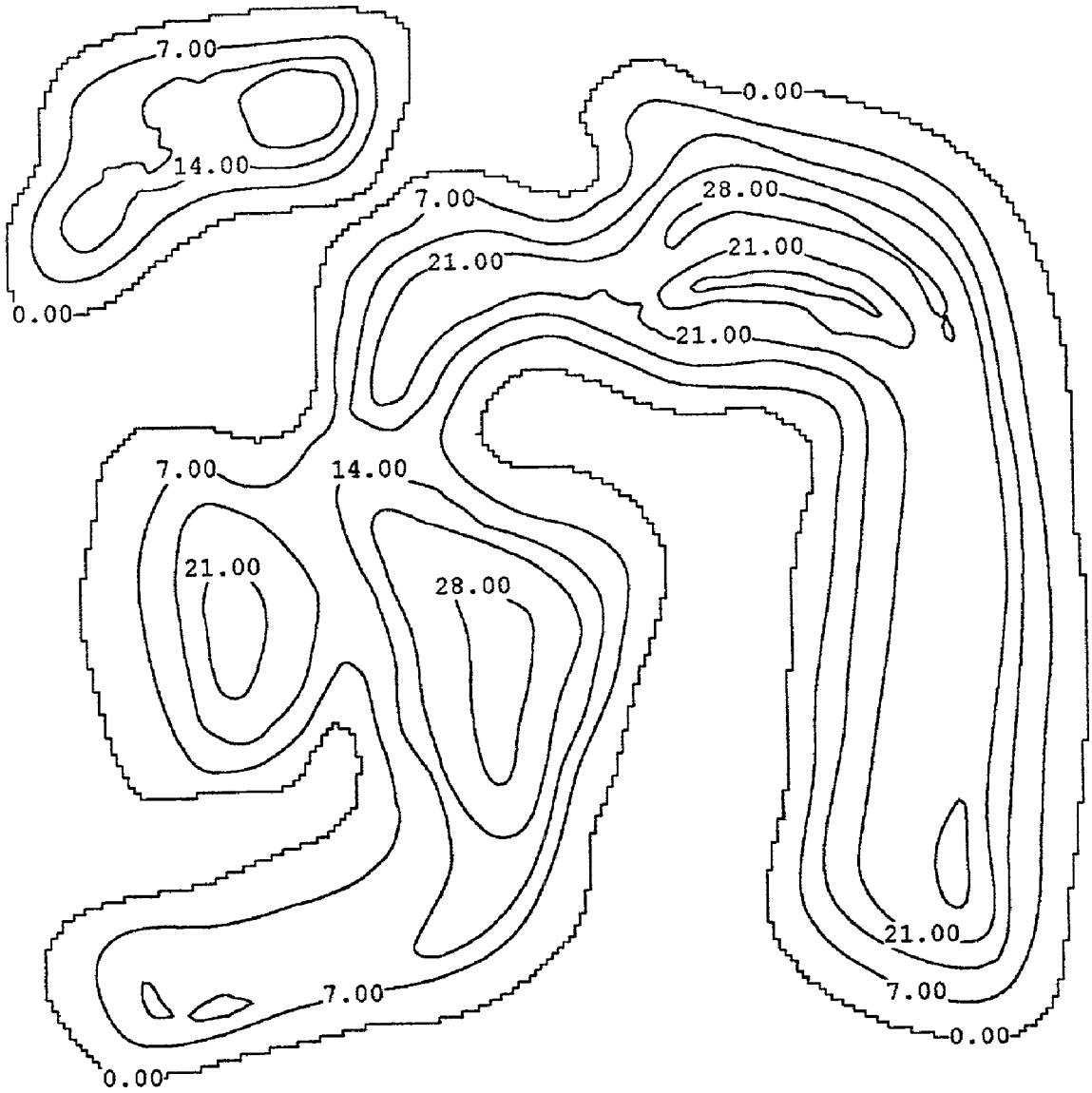
FIG. 6 is a fluid reservoir map indicating physical characteristics of map cells.

FIG. 6 is a fluid reservoir map indicating physical characteristics of map cells. The net sand thickness for each cell is used as the physical characteristic on which the walkers partly base their transition probability to move into an adjacent cell for the next step. The numbers shown on the contour lines indicate the net sand thickness of the reservoir along that contour line. The net sand thickness in cells between the contours lines is not indicated, but is stored for use in walker step calculations. As discussed above, the physical characteristic value is only part of the stochastic step calculation. Whether the cell is corner or side adjacent can also affect the probabilities to which a random number is applied.

Figure 7:
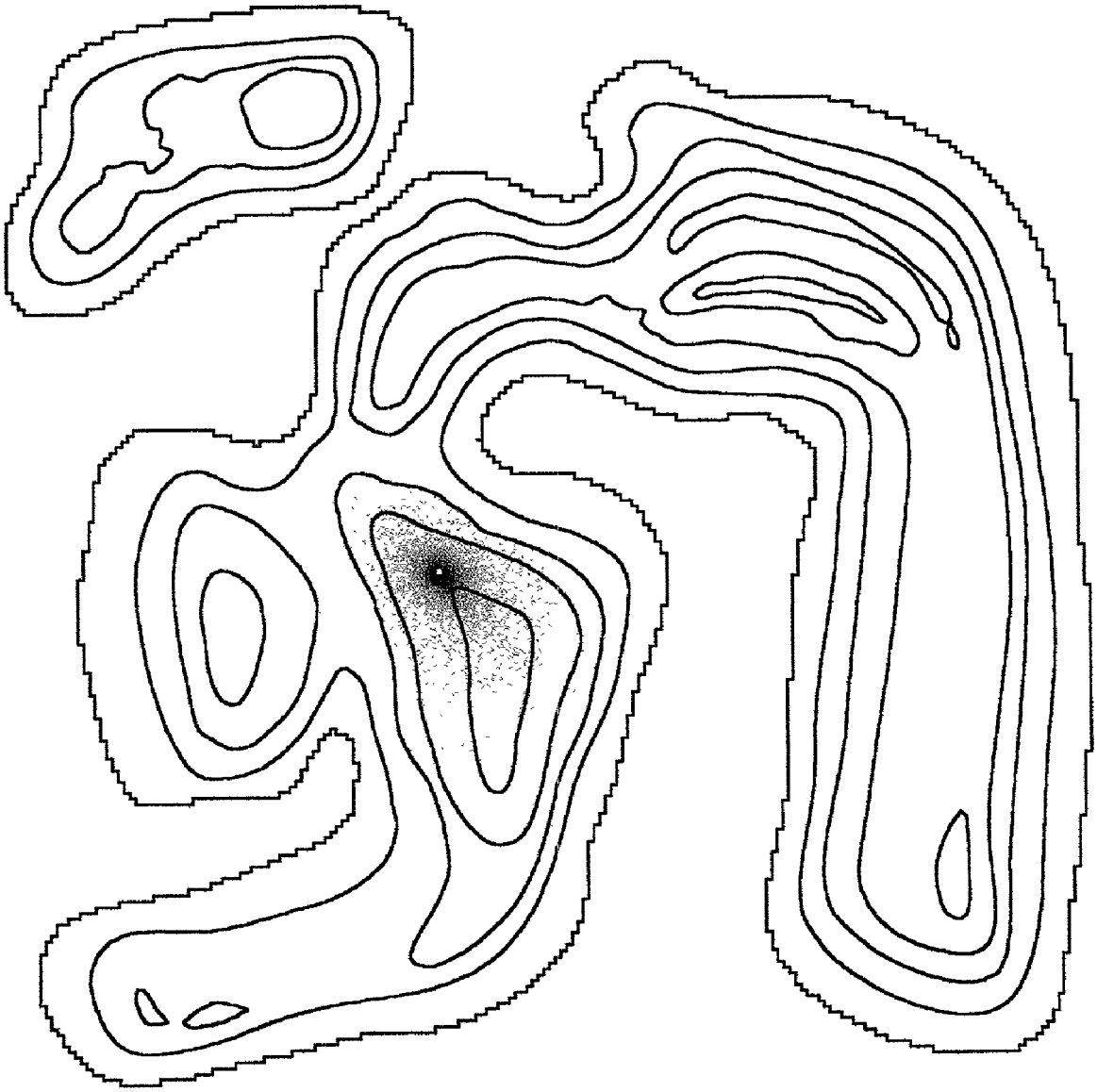
FIG. 7 is a fluid reservoir map indicating walker steps in each map cell.

FIG. 7 is a fluid reservoir map indicating the number of walker visits in each map cell for one of the six producer wells. As discussed above, any subset of the actual producer wells present in the reservoir whose map is being analyzed can be modeled. The greater density of dots or shading indicates more walker visits per cell. As can be seen from the figure, the weighting of step probability influenced the walkers toward areas with thicker net sand and away from areas with thin net sand. The amount of visits per cell is then used to allocate the fluid depletion amount that will be assigned to the producer well.

Figure 8:
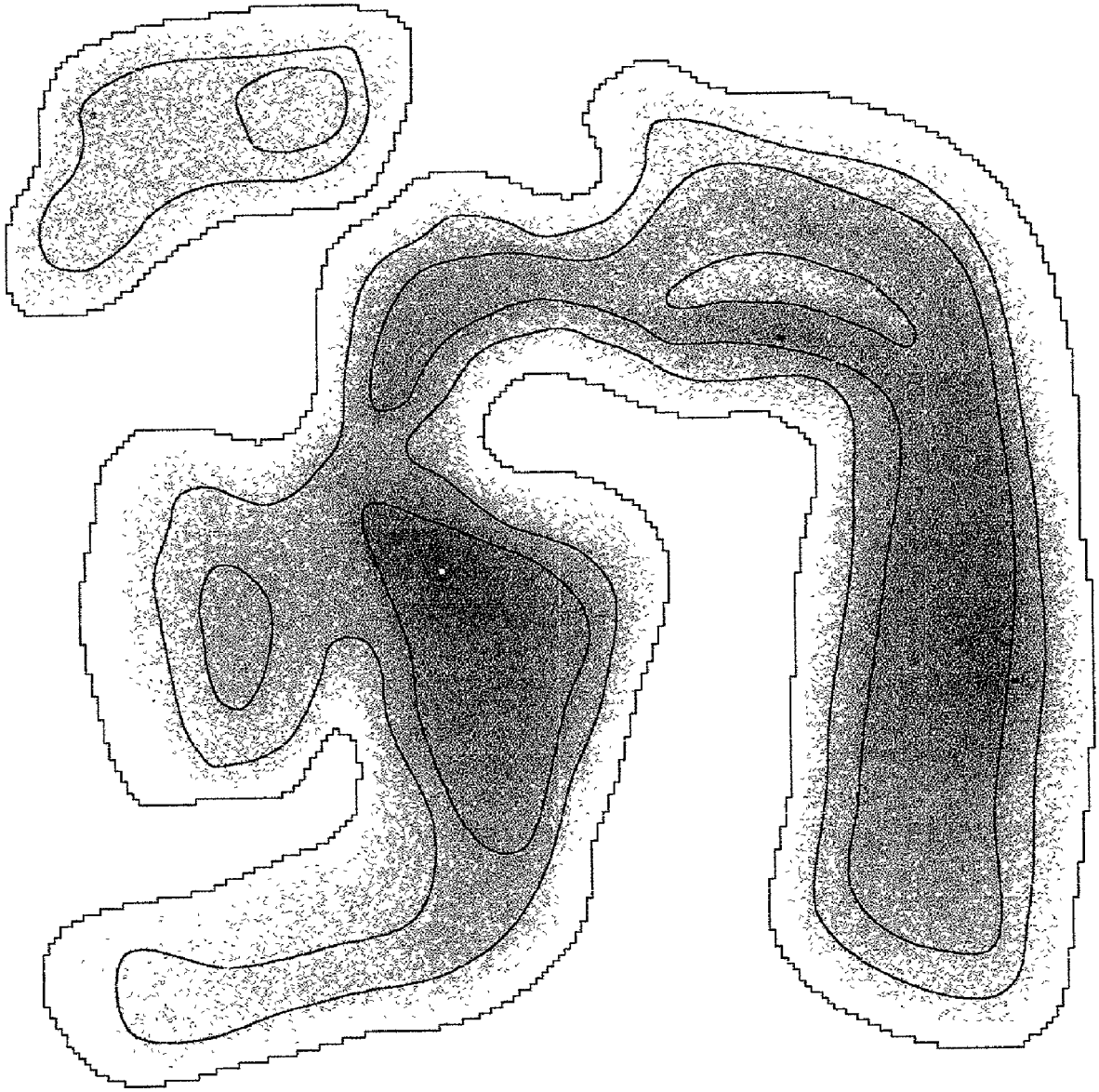
FIG. 8 is a fluid reservoir map indicating amount of fluid removed.

FIG. 8 is a fluid reservoir map indicating amount of fluid removed. Because the fluid removed is proportional to the number of walker visits, it does not group circularly around the well locations. Instead, a combination of the well locations (where the walkers start) and the areas with thick net sand (where the walker steps are more likely to occur) determines from where the fluid is removed. In contiguous reservoir areas with multiple wells (the larger of the two noncontiguous reservoir areas), the fluid removal from the various wells is additive so that a particular cell may be depleted from multiple wells. Because only one well was modeled in the smaller reservoir area (in the upper left), all fluid depletion resulted from a single well.

Figure 9:
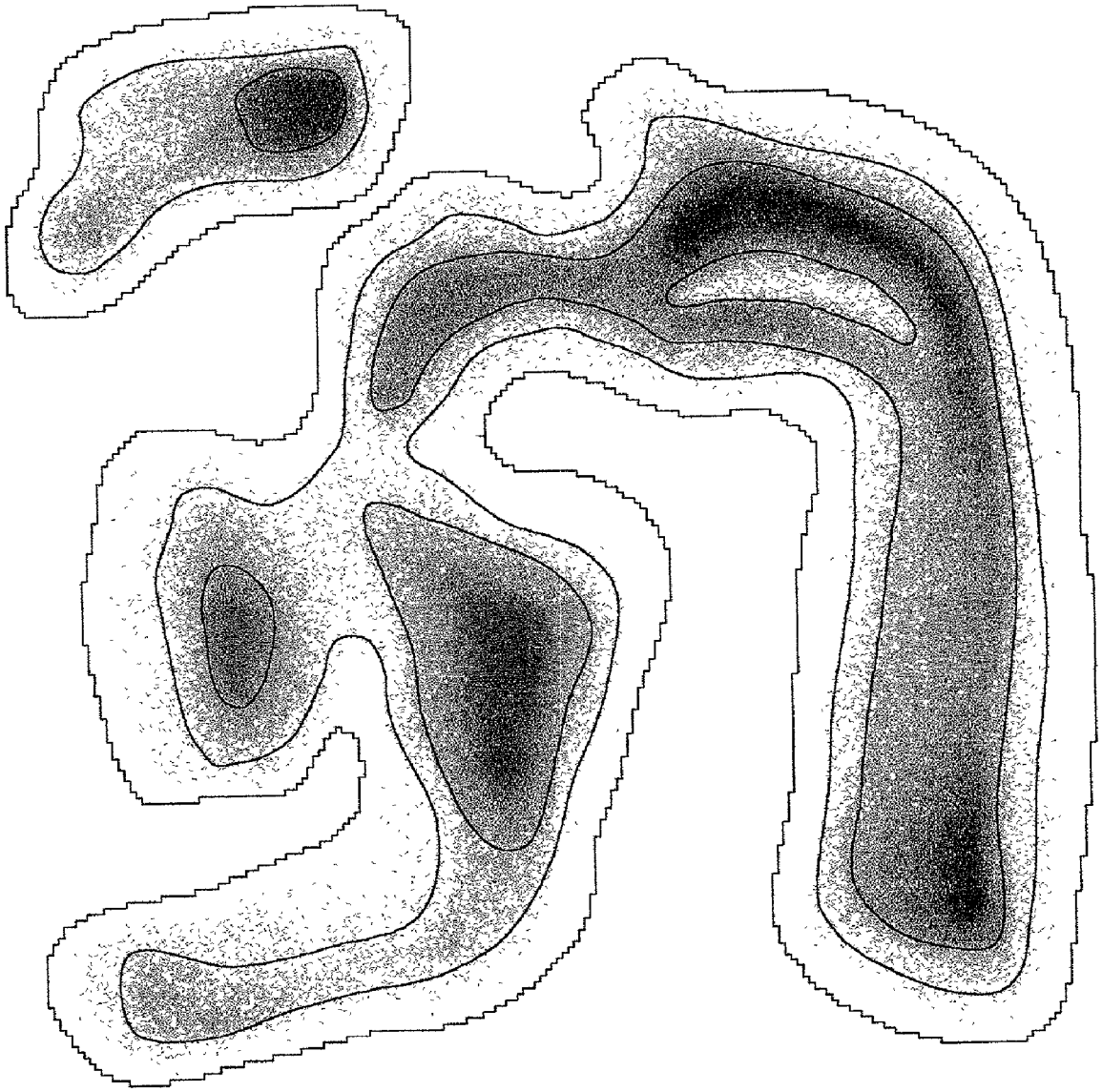
FIG. 9 is a fluid reservoir map indicating remaining fluid volume.

FIG. 9 is a fluid reservoir map indicating remaining fluid volume. The remaining fluid volumes are just the difference between FIGS. 5 and 8. Implementations of the invention can result in either the fluid depletion per cell or in the remaining fluid per cell. The example resulted from performance of the method on a digital computer.

The present invention can also be embodied in the form of computer-implemented processes and apparatus for practicing those processes. The present invention can also be embodied in the form of computer program code embodied in tangible media, such as floppy diskettes, CD-ROMs, hard drives, or any other computer-readable storage medium, wherein, when the computer program code is loaded into and executed by a computer, the computer becomes an apparatus for practicing the invention. The present invention can also be embodied in the form of computer program code, for example, whether stored in a storage medium, loaded into and/or executed by a computer, or transmitted as a propagated computer data or other signal over some transmission or propagation medium, such as over electrical wiring or cabling, through fiber optics, or via electromagnetic radiation, or otherwise embodied in a carrier wave, wherein, when the computer program code is loaded into and executed by a computer, the computer becomes an apparatus for practicing the invention. When implemented on a future general purpose microprocessor sufficient to carry out the present invention, the computer program code segments configure the microprocessor to create specific logic circuits to carry out the desired process.

The text above described one or more specific implementations of a broader invention. The invention also is carried out in a variety of alternative implementations and thus is not limited to those described here. Many other implementations are also within the scope of the following claims.

What is claimed is:

1. A method for modeling fluid depletion, the method comprising the steps of dividing a map into cells;

storing a value for each of the map cells based at least in part on a physical characteristic of the cell;

identifying a cell that contains a first removal location, the first removal location having a first removal amount;

specifying a number of walkers for the first removal location;

for each walker, calculating a plurality of steps starting at the associated removal location, each step made to an adjacent cell, the choice of adjacent cell being weighted at least in part by the value of the cells;

recording the steps of all the walkers by cell; and assessing fluid depletion of each cell based at least in part on the number of walker steps for each cell, including:

(a) dividing the first removal amount by the sum of the number of steps for all walkers to determine a depletion amount per step;

(b) allocating to each cell the product of the depletion amount per step and the number of steps recorded for that cell;

(c) if one or more cells is allocated more than a maximum depletion amount:

adding together the amount of allocation above the maximum depletion amount for the one or more cells to determine the remaining depletion amount;

lowering the allocation for the one or more cells to the maximum depletion amount;

dividing the remaining depletion amount by the sum of the number of recorded steps for cells that have been allocated less than the maximum depletion amount to determine a remaining depletion amount per step;

adding to the allocation to each cell that has been allocated less than the maximum depletion amount the product of the remaining depletion amount per step and the number of steps recorded for that cell; and (d) repeating step (c) until no cell is allocated more than the maximum depletion amount.

2. The method of claim 1 where a first map cell has a different maximum depletion amount than a second map cell.

3. A computer program, stored in a tangible medium, for modeling fluid depletion, the program comprising executable instructions that cause a computer to divide a map into cells;

store a value for each of the map cells based at least in part on a physical characteristic of the cell;

identify a cell that contains a first removal location, the first removal location having a first removal amount;

specifying a number of walkers for the first removal location;

for each walker, calculate a plurality of steps starting at the associated removal location, each step made to an adjacent cell, the choice of adjacent cell being weighted at least in part by the value of the cells;

record the steps of all the walkers by cell; and assess fluid depletion of each cell based at least in part on the number of walker steps for each cell, including executable instructions that cause a computer to:

(a) divide the first removal amount by the sum of the number of steps for all walkers to determine a depletion amount per step;

(b) allocate to each cell the product of the depletion amount per step and the number of steps recorded for that cell;

(c) if one or more cells is allocated more than a maximum depletion amount:

add together the amount of allocation above the maximum depletion amount for the one or more cells to determine the remaining depletion amount;

lower the allocation for the one or more cells to the maximum depletion amount;

divide the remaining depletion amount by the sum of the number of recorded steps for cells that have been allocated less than the maximum depletion amount to determine a remaining depletion amount per step;

add to the allocation to each cell that has been allocated less than the maximum depletion amount the product of the remaining depletion amount per step and the number of steps recorded for that cell; and (d) repeat step (c) until no cell is allocated more than the maximum depletion amount.

4. The computer program of claim 3 where a first map cell has a different maximum depletion amount than a second map cell.

* * * * *